US011761238B2

(12) United States Patent
Carlsen

(10) Patent No.: US 11,761,238 B2
(45) Date of Patent: Sep. 19, 2023

(54) LOCKING DEVICE AND METHOD

(71) Applicant: Robert Carlsen, Sacramento, CA (US)

(72) Inventor: Robert Carlsen, Sacramento, CA (US)

( * ) Notice: Subject to any disclaimer, the term of this patent is extended or adjusted under 35 U.S.C. 154(b) by 302 days.

(21) Appl. No.: 17/316,396

(22) Filed: May 10, 2021

(65) Prior Publication Data

US 2022/0356733 A1 Nov. 10, 2022

(51) Int. Cl.
*E05B 27/00* (2006.01)
*E05B 29/00* (2006.01)

(52) U.S. Cl.
CPC ..... *E05B 27/0075* (2013.01); *E05B 27/001* (2013.01); *E05B 27/0007* (2013.01); *E05B 27/0017* (2013.01); *E05B 27/0046* (2013.01); *E05B 29/006* (2013.01); *E05B 29/0033* (2013.01)

(58) Field of Classification Search
CPC ..... E05B 27/0007; E05B 27/001; E05B 27/0017; E05B 27/0046; E05B 27/0057; E05B 27/0075; E05B 29/0026; E05B 29/0033; E05B 29/006
See application file for complete search history.

(56) References Cited

U.S. PATENT DOCUMENTS 2,783,636 A * 3/1957 Scott ..... E05B 27/001 70/420
3,427,413 A * 2/1969 Maddison ..... E05B 45/06 70/417
4,077,240 A * 3/1978 Crasnianski ..... E05B 29/0033 70/377
5,475,997 A * 12/1995 Chung ..... E05B 27/001 70/358
5,799,519 A * 9/1998 Hsiao ..... E05B 27/001 70/358
6,058,752 A * 5/2000 Feder ..... E05B 27/001 70/423
8,291,735 B1 * 10/2012 Damikolas ..... E05B 27/001 70/494
11,572,708 B2 * 2/2023 Farag ..... E05B 27/005
2004/0226327 A1 * 11/2004 Chou ..... E05B 27/001 70/358
2005/0172687 A1 * 8/2005 Segien ..... E05B 27/0021 70/384
2006/0096345 A1 * 5/2006 Chen ..... E05B 27/001 70/493
2021/0355709 A1 * 11/2021 Bowley ..... E05B 27/001

* cited by examiner

*Primary Examiner* — Christopher J Boswell
(74) *Attorney, Agent, or Firm* — Fish & Richardson P.C.

(57) ABSTRACT

An improved locking device comprising a lock body, a locking plug, and a plurality of tumblers, wherein the tumblers are restricted from moving with respect to the locking plug during the time frame that the locking plug is rotated with respect to the lock body.

20 Claims, 17 Drawing Sheets

135
135
135
135
135
145
145
145

Figure 14
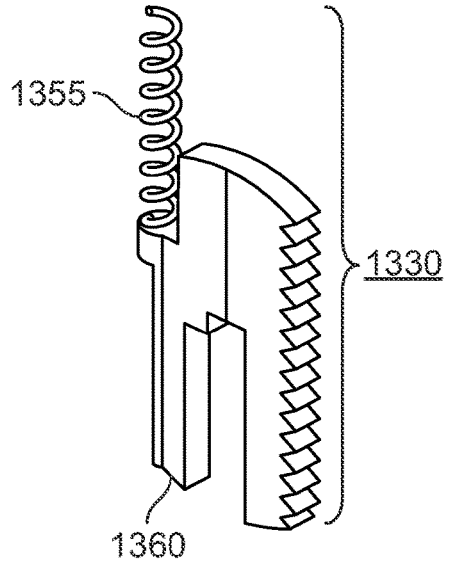
Figure 15
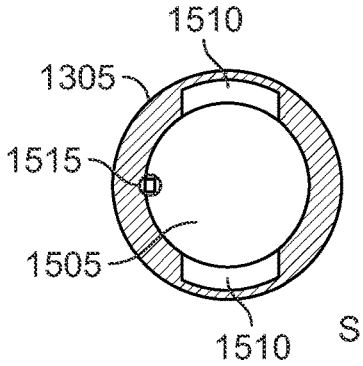
SECTION B-B
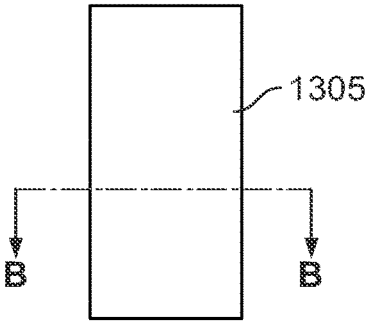
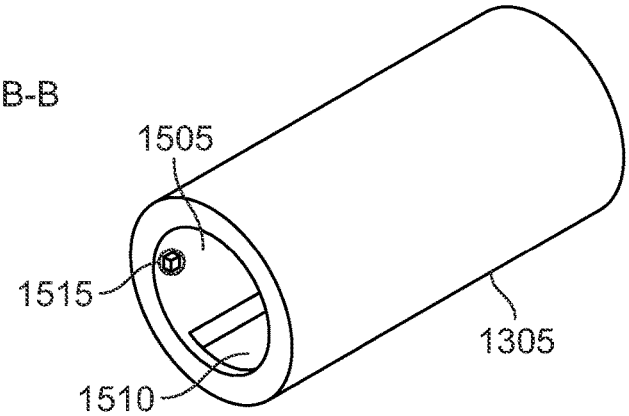
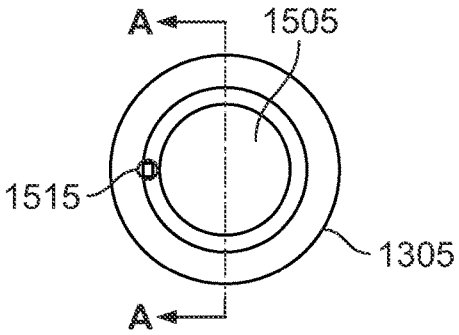
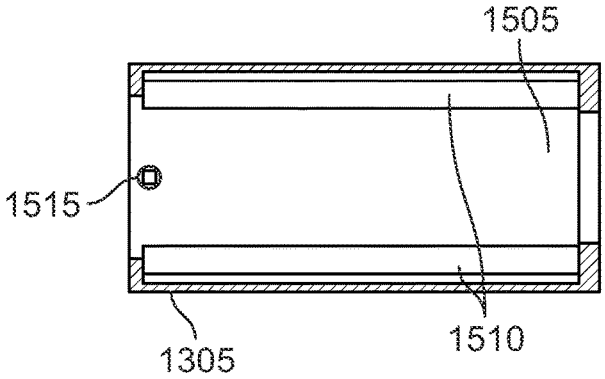
SECTION A-A 1315
1345
1345
1345
1345
1345
1395
1345
1345
1345
1345
1345
1345
1315
1395
1315
1345
1345
1345
1345
1345
1345
1345
1350
1350
1350
1350
1350
1350
1350
1350
1350
1350
1350
1350
1350
1350
1350
1350
1350
1395
1350
1350
1350
1350
1350
1350
1350
1350
1350
1350
1350
1350
1350
1350
1350
1350
1350

LOCKING DEVICE AND METHOD

TECHNICAL FIELD

This disclosure relates to a locking device, and in some implementations, its method of use.

BACKGROUND

Locks are useful devices for securing doors, drawers, windows, and other entryways from unauthorized access. Although many different locking devices exist, a longstanding and frequently used design comprises the "lock and key" style locking device, where a mechanical or electronic fastening device is released by a physical object, often in the form of a metallic key.

Common lock-and-key style devices often include a lock body having a locking plug and a series of pin or wafer tumblers. When locked, the pin or wafer tumblers rest in positions that prevent the locking plug from fully rotating within the lock body from a closed or locked position to an open or unlocked position. When a key is inserted, notches and ridges in the key will line up with the pin or wafer tumblers, adjusting their vertical position within the lock body and locking plug. If the proper key for the lock is inserted, the pin or wafer tumblers will be displaced to a height that allows the locking plug to fully rotate within the lock body, opening the lock and associated entryway.

Various methods have been developed to obtain unauthorized access to lock and key devices, using tools and techniques often referred to as "lock picking." One common method of picking a lock-and-key style locking device is for a lock picker to use a tool to manipulate the locking plug, causing it to partially rotate and bind the pin or wafer tumblers in position. The lock picker may then use another tool to manipulate the individual pin or wafer tumblers, moving to vertical positions that allow the locking plug to fully rotate to the unlocked position.

Efforts to design locks which cannot be picked by such traditional lock picking methods, or which increase the difficulty of such lock picking have generally been cumbersome, expensive, or impractical as replacements for traditional lock and key devices.

SUMMARY

Some embodiments described herein include an improved locking device that hinders simultaneous rotation of a locking plug and movement of pin or wafer tumblers. In some embodiments, if the tumblers are free to move, the locking plug cannot rotate, and likewise, if the locking plug can rotate, the tumblers are not able to be moved.

In one example, the locking device may optionally include a lock body and a roughly cylindrical locking plug inserted into the lock body, the locking plug having a first and second locking plug segment wherein the first locking plug segment is able to move longitudinally with respect to the second locking plug segment within the lock body. In some implementations, the first locking plug segment may have a plurality of slots for accommodating a plurality of wafer tumblers. The second locking plug segment may optionally include a corresponding plurality of slots for accommodating the plurality of wafer tumblers, such that when the slots on the first and second locking plug segment are aligned (by movement of the first locking plug segment longitudinally with respect to the second locking plug segment), the wafer tumblers are free to move up and down within the slots. In some implementations, the second locking plug segment may also include a plurality of serrated sections adjacent to the plurality of slots, such that when the plurality of slots on the first and second locking plug segments are not aligned, the serrations on the second locking plug segment engage with corresponding serrations on the wafer tumblers, preventing them from moving up or down in the vertical direction.

In some embodiments, the first locking plug segment may include a rotational relief channel extending around the circumference of the first locking plug segment, and a longitudinal relief channel extending from a portion of the rotational relief channel longitudinally along at least a portion of the first locking plug segment. Optionally, the lock body may include a locking pin configured to engage with the longitudinal relief channel and the rotational relief channel on the first locking plug segment. In particular implementations, the first locking plug segment may be biased by a spring such that the first locking plug segment may move longitudinally with respect to the lock body and the second locking plug segment. In a resting position, the first locking plug segment may be biased such that the locking pin on the lock body is resting in the longitudinal relief channel, but not the rotational relief channel, preventing rotational movement of the locking plug with respect to the lock body. When the first locking plug segment is moved in the longitudinal direction, compressing the spring, the locking pin may move down the longitudinal relief channel into the rotational relief channel, such that the locking plug may be rotated within the lock body.

In other embodiments, the locking plug may comprise a pin tumbler locking plug having a first pin tumbler locking plug portion that may move longitudinally within the lock body with respect to a second pin tumbler locking plug portion. In some implementations, the first pin tumbler locking plug portion may comprise a plurality of channels for accommodating a plurality of pin tumblers. In some embodiments, the locking device further includes a pin tumbler holder located above an upper portion of the first pin tumbler locking plug portion and also includes a plurality of pin channels corresponding to the plurality of pin tumblers, such that the plurality of pin tumblers may move up and down within the pin channels of the pin tumbler holder when the pin tumblers are free to move. The second pin tumbler locking plug portion may optionally include a corresponding plurality of channels for accommodating at least a portion of each of the plurality of pin tumblers, such that when the channels on the first and second pin tumbler locking plug segments and the pin tumbler holder are aligned (by movement of the first pin tumbler locking plug portion and pin tumbler holder longitudinally with respect to the second pin tumbler locking plug portion), the pin tumblers are free to move up and down within the channels. In some implementations, the second pin tumbler locking plug portion may also include a plurality of serrated sections adjacent to the plurality of channels, such that when the plurality of channels are not aligned, the serrations on the second pin tumbler locking plug portion engage with corresponding serrations on the pin tumblers, preventing them from moving up or down within the channels.

In some embodiments, the pin tumbler holder may include a locking pin configured to engage with a locking pin channel on the second pin tumbler locking plug segment. In particular implementations, the first pin tumbler locking plug portion and pin tumbler holder may be biased by a spring such that the first pin tumbler locking plug portion and pin tumbler holder may move longitudinally with respect to the lock body and the second pin tumbler locking plug segment. In a resting position, the first pin tumbler locking plug segment and pin tumbler holder may be biased such that the locking pin on the pin tumbler holder is resting in the locking pin channel on the second pin tumbler locking plug segment, preventing rotational movement of the first and second pin tumbler locking plug segments with respect to the lock body. When the first pin tumbler locking plug segment and pin tumbler holder are moved in the longitudinal direction, compressing the spring, the locking pin may move out of the locking pin channel on the second pin tumbler locking plug segment, such that the first and second pin tumbler locking plug segments may rotate with respect to the lock body.

Particular embodiments described herein include a locking device having a lock body housing a locking plug having a first portion fixed with respect to the lock body and a second portion moveable with respect to the first portion of the locking plug and the lock body. Some embodiments further include the first portion of the locking plug comprising a plurality of channels for accommodating vertical movement of a plurality of lock tumblers when the second portion of the locking plug is in a first position with respect to the lock body. Optionally, the first portion of the locking plug comprises a plurality of engagement surfaces that engage with the plurality of lock tumblers to prevent vertical movement of the lock tumblers when the second portion of the locking plug is in a second position. Some embodiments further include a rotational locking tab that prevents rotation of one of the first and second locking plug portions with respect to the lock body when the second portion of the locking plug is in the first position.

Some embodiments described herein include a method of opening a locking device. The method may include inserting an authorized key into the locking device and rotating the key from a first position to a second position, wherein the locking device comprises a lock body housing a locking plug having a first portion fixed with respect to the lock body and a second portion moveable with respect to the first portion of the locking plug and the lock body. In some implementations, the locking device hinders simultaneous rotation of the locking plug and vertical movement of a plurality of lock tumblers within the locking device.

Other embodiments may comprise a locking device having a lock body housing a locking plug having a first portion fixed with respect to the lock body and a second portion moveable with respect to the first portion of the locking plug and the lock body. Some implementations may include a means for hindering rotation of the locking plug when the second portion of the locking plug is in a first position. Optionally, some embodiments may further comprise a means for hindering vertical movement of a plurality of locking tumblers when the second portion of the locking plug is in a second position.

A number of embodiments described herein may provide one or more of the following advantages. First, some embodiments provide a lock having a lock body and a locking plug, wherein the locking plug comprises a plurality of segments, at least one of which may move in the longitudinal direction with respect to the lock body and at least one other segment of the locking plug. When the segments of the locking plug are in a first position, a plurality of tumblers, such as pin or wafer tumblers, are free to move in the vertical direction. However, when the segments of the locking plug are in this first position, the locking plug is unable to rotate with respect to the locking body. When the segments of the locking plug are in a second position, a plurality of tumblers, such as pin or wafer tumblers, are prevented from moving in the vertical direction, such as by the engagement of serrated sections on the tumblers with corresponding serrated sections on one more of the locking plug segments. However, when the segments of the locking plug are in this second position, the locking plug is able to rotate with respect to the locking body. As such, the tumblers may not be manipulated or moved in the vertical direction at the same time that the locking plug may be rotated, thereby increasing the difficulty in picking the lock, because the lock picker is unable to "bind" the tumblers by partial rotation of the locking plug and manipulate them in the vertical direction at the same time. Second, some embodiments described herein are designed to have a similar size and shape as conventional lock and key designs, such that they may be used in place of such conventional designs without significantly increased expense or complexity, and without requiring specialized or expensive keys and other access media.

The details of one or more embodiments are set forth in the accompanying drawings and the description below. Other features, objects, and advantages will be apparent from the description and drawings, and from the claims.

DESCRIPTION OF DRAWINGS

FIG. 11 shows various perspectives and cross-sections of the locking device of FIG. 1 with a key inserted and the first portion of a locking plug and a pin holder in a first position.

FIG. 14 shows various perspectives and cross-sections of portions of the wafer tumblers and springs of FIG. 13.

FIG. 15 shows various perspectives and cross-sections of portions of the lock body of FIG. 13.

Like reference symbols in the various drawings indicate like elements.

DETAILED DESCRIPTION OF ILLUSTRATIVE EMBODIMENTS

Figure 1:
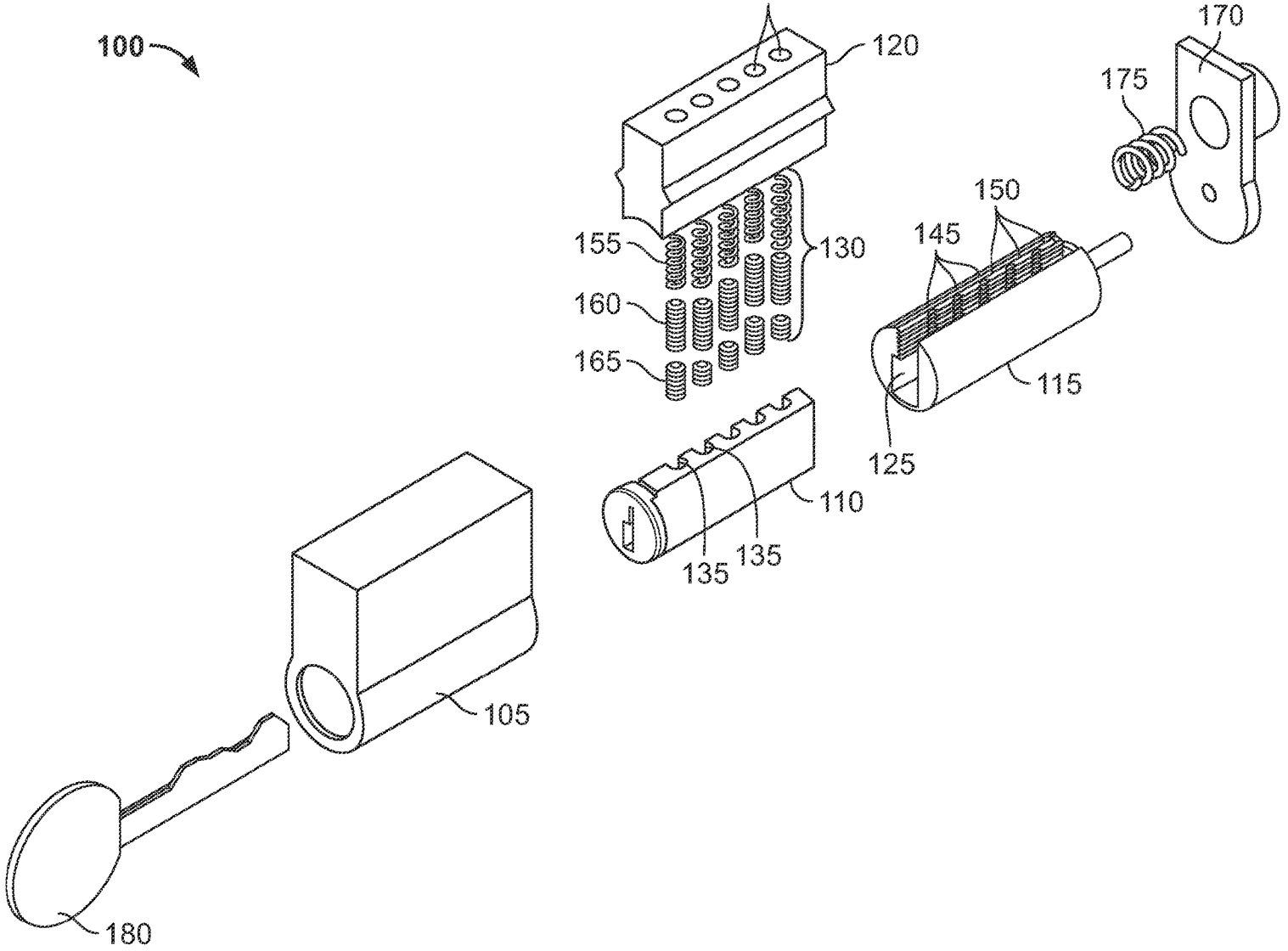
FIG. 1 shows a perspective view of an embodiment of a locking device having pin tumblers.

Referring now to FIG. 1, an embodiment of an improved locking device 100 is shown. Some embodiments of the improved locking device 100 may comprise a lock body 105, a pin tumbler holder 120, and a locking plug having a first portion 110 and a second portion 115. In particular implementations, such as shown in FIG. 1, locking plug portion 110 may be configured to fit into a channel portion 125 of locking plug portion 115. In some embodiments, lock body 105 is configured to receive locking plug portions 110, 115 and pin tumbler holder 120 at least partially within lock body 105.

Figure 7:
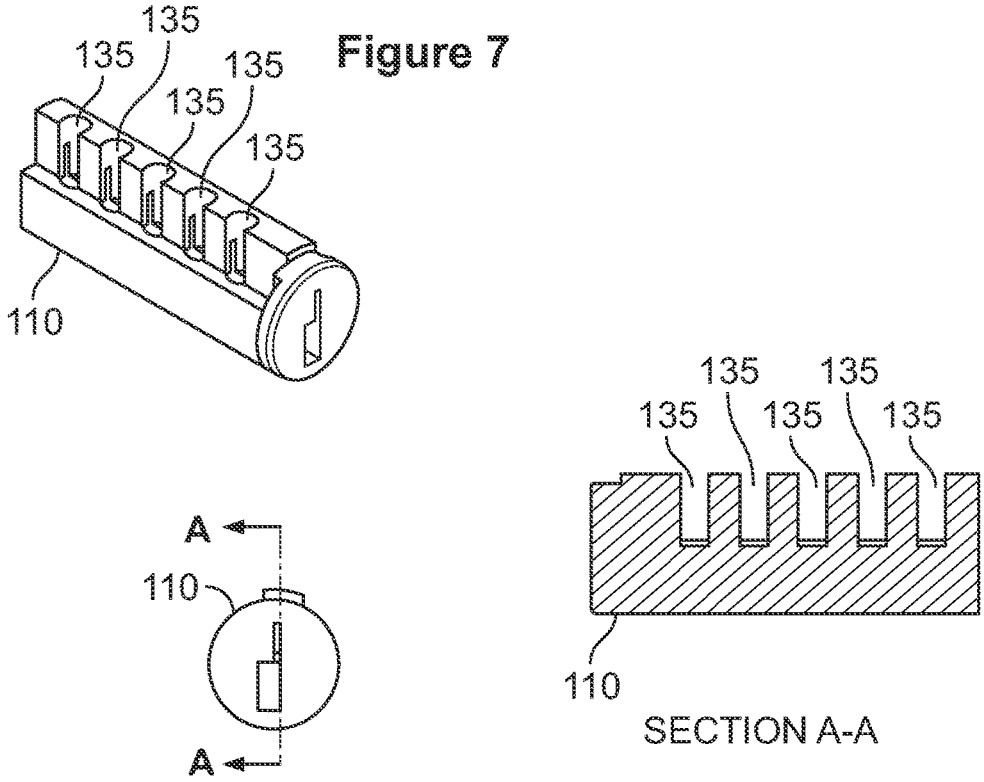
FIG. 7 shows various perspectives and cross-sections of another portion of a locking plug of the locking device of FIG. 1.
Figure 8:
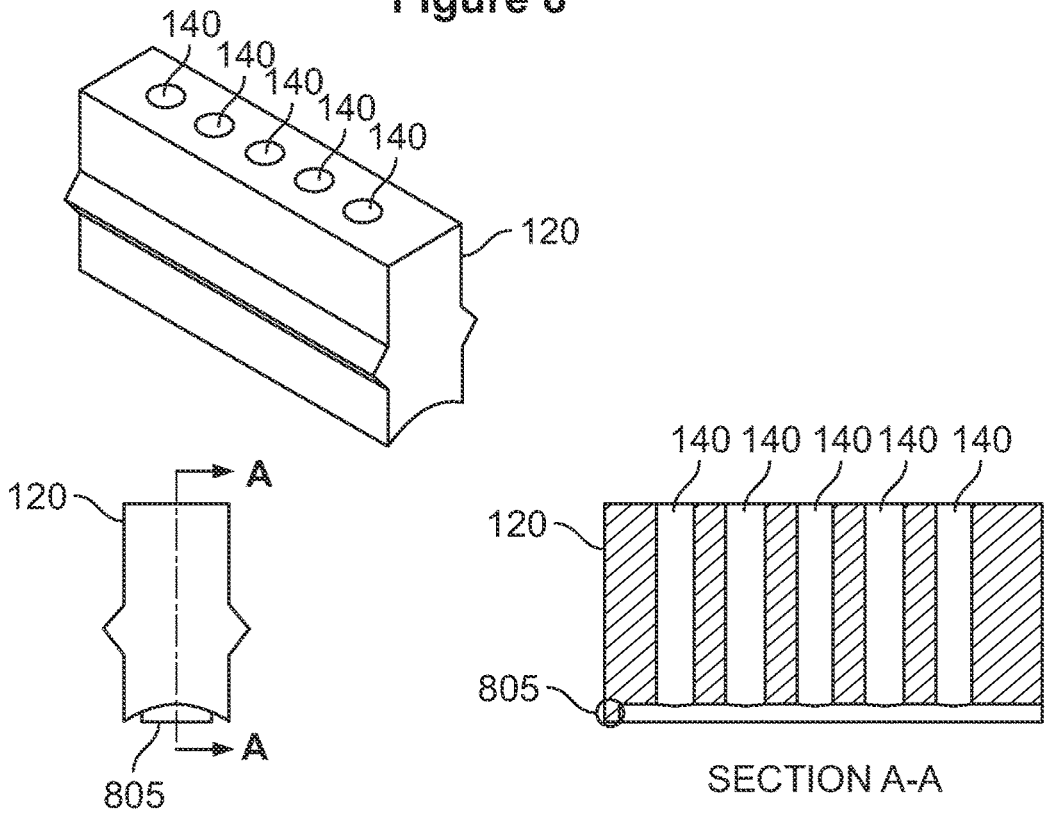
FIG. 8. Shows various perspectives and cross-sections of a pin tumbler holder of the locking device of FIG. 1.

As can be further seen in FIG. 1 and FIG. 7, in some embodiments locking plug portion 110 may include a plurality of channels 135 for accommodating a plurality of pin tumblers 130. As shown in connection with FIG. 1 and FIG. 8, pin tumbler holder 120 may be located above locking plug portion 110 and comprise a corresponding plurality of channels 140 to similarly accommodate the plurality of pin tumblers 130.

Figure 9:
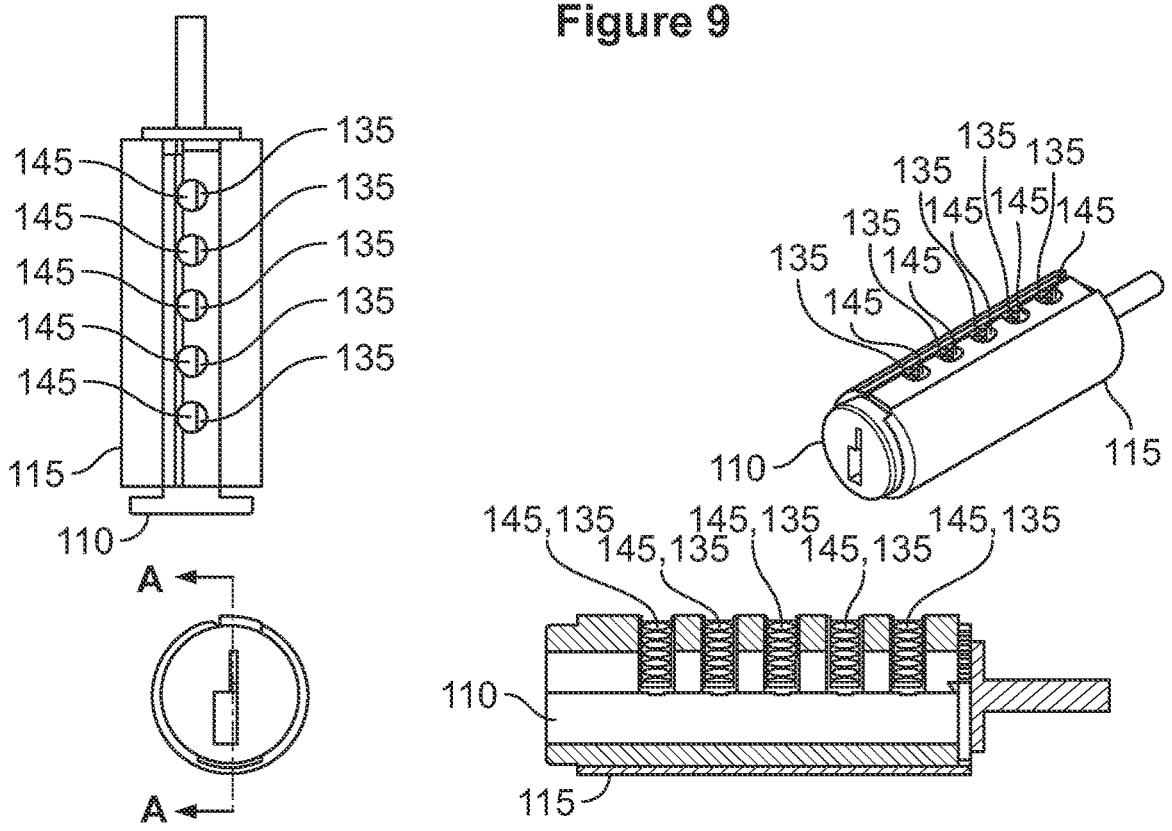
FIG. 9 shows various perspectives and cross-sections of a first and second portion of a locking plug of the locking device of FIG. 1 in a first position.
Figure 10:
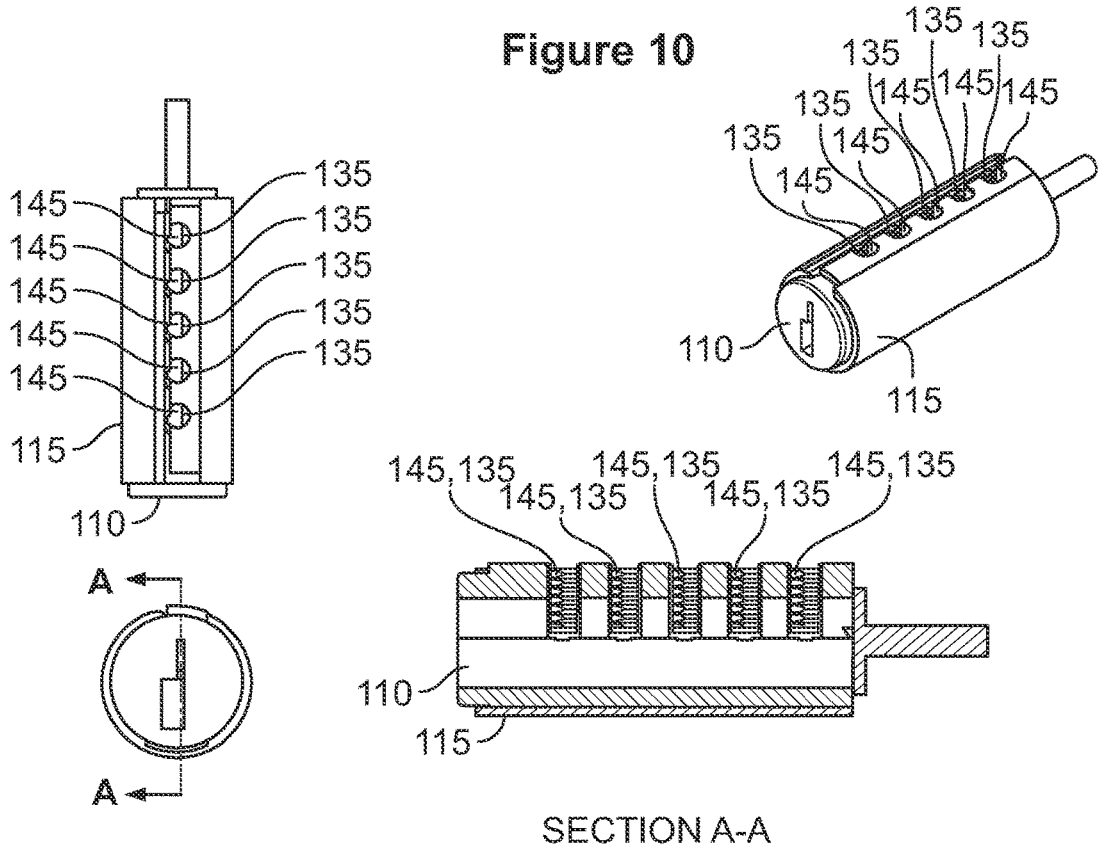
FIG. 10 shows various perspectives and cross-sections of a first and second portion of a locking plug of the locking device of FIG. 1 in a second position.

The locking plug portion 115 may comprise a plurality of channels 145 for accommodating the plurality of pin tumblers 130 (as described below in additional detail with respect to FIG. 6). In particular implementations, and as shown in FIG. 9, when the channels 145 of locking plug portion 115 are aligned with the channels 135 of locking plug portion 110, pin tumblers 130 are free to move up and down within channels 135, 145. Optionally, as shown in detail with respect to FIG. 10, locking plug portion 115 may also comprise a plurality of pin tumbler locking sections, such as serrated portions 150 for engaging with pin tumblers 130 when channels 145 of locking plug portion 115 are not aligned with channels 135 of locking plug portion 110, thereby preventing pin tumblers 130 from moving up and down.

Still referring to FIG. 1, pin tumblers 130 may comprise a plurality of elements, such as pin springs 155, upper pins 160, and lower pins 165. In other embodiments, pin tumblers 130 may comprise additional pieces, such as intermediary pin portions, or one or more of upper pins 160 and lower pin 165 may be substituted for a single pin element. Pin springs 155 are configured to bias upper pins 160 and lower pins downward. As further shown in FIG. 1, upper pins 160 and lower pins 165 may be of varying lengths with respect to each other and one another, such that each pin tumbler 130 must be raised a different amount (through the use of a proper key) to allow locking device 100 to rotate and be opened.

As further shown in FIG. 1, locking device 100 may further comprise rear lock body plate 170 and lock plate spring 175. In some embodiments, lock plate spring is configured to engage with pin tumbler holder 120, and bias pin tumbler holder 120 and locking plug portion 110 away from rear lock body plate 170. Locking device 100 may further comprise a key 180 for operating locking device 100.

Figure 2:
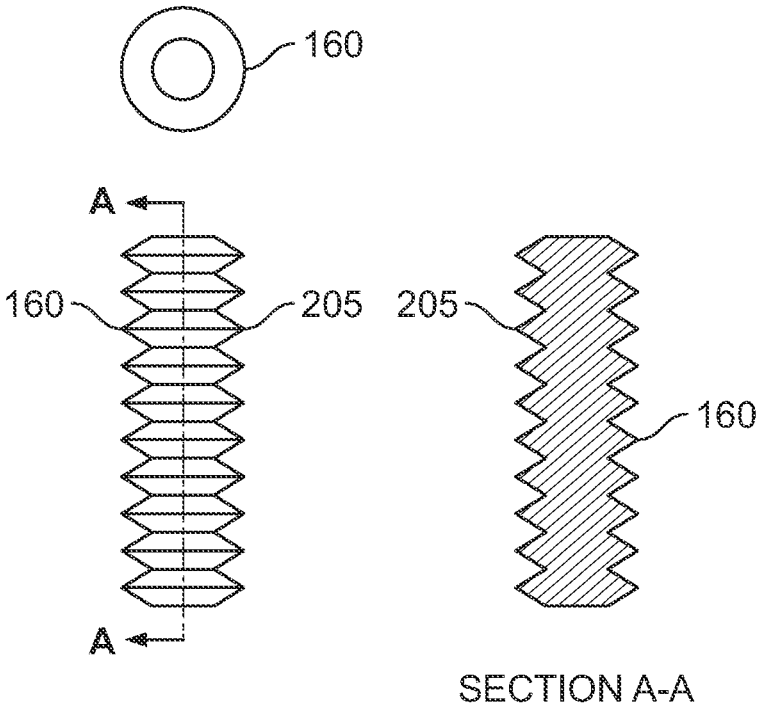
FIG. 2 shows various perspectives and cross-sections of portions of the pin tumblers of FIG. 1

Referring to FIG. 2, upper pins 160 and/or lower pins 165 of pin tumblers 130 may in some embodiments have serrated edges 205. In some embodiments serrated edges 205 of pin tumblers 130 may have the same serration frequency as serrated portions 150 of locking plug portion 115, such that when pin tumblers 130 are aligned with serrated portions 150 of locking plug portion 115, pin tumblers 130 are prevented from moving up or down with respect to locking plug portions 110, 115 and pin tumbler holder 120.

Figure 3:
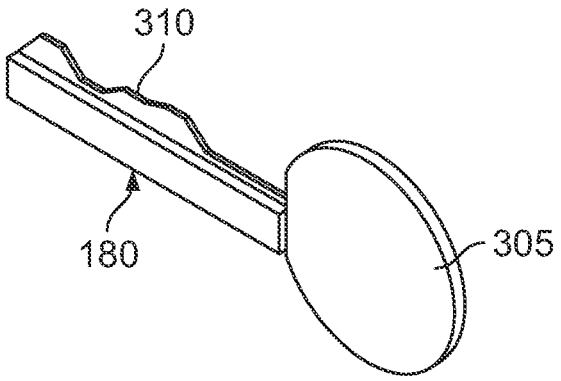
FIG. 3 shows various perspectives of a key for use with the locking device of FIG. 1.

Referring to FIG. 3, key 180 may comprise a handle portion 305 and a key ridge portion 310. As described in further detail below with respect to FIG. 12, ridge portion 310 is configured to engage with pin tumblers 130, such that when the correct key 180 is inserted into locking device 100, pin tumblers 130 are raised by varying heights corresponding to the changes in elevation on ridge portion 310.

Figure 4:
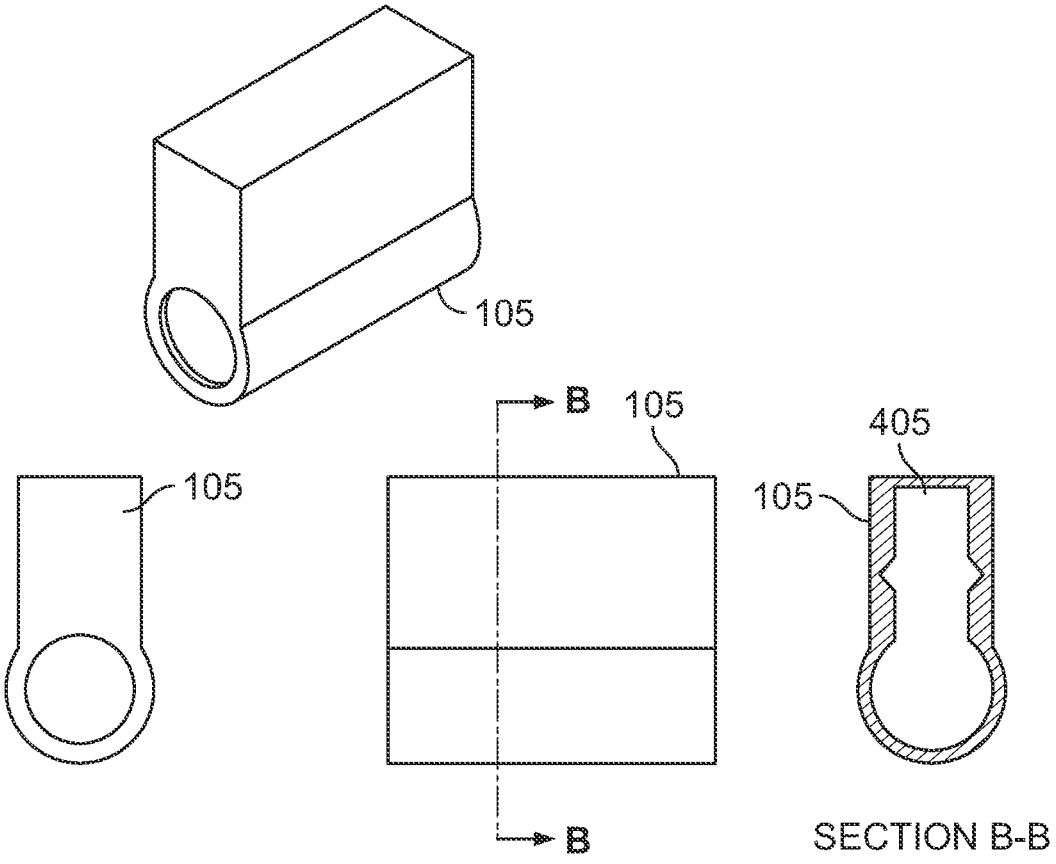
FIG. 4 shows various perspectives and cross-sections of a lock body of the locking device of FIG. 1.

Referring to FIG. 4, the depicted embodiment of the lock body 105 may comprise a cavity 405 for receiving other components of locking device 100, including pin tumbler holder 120 and locking plug portions 110, 115.

Figure 5:
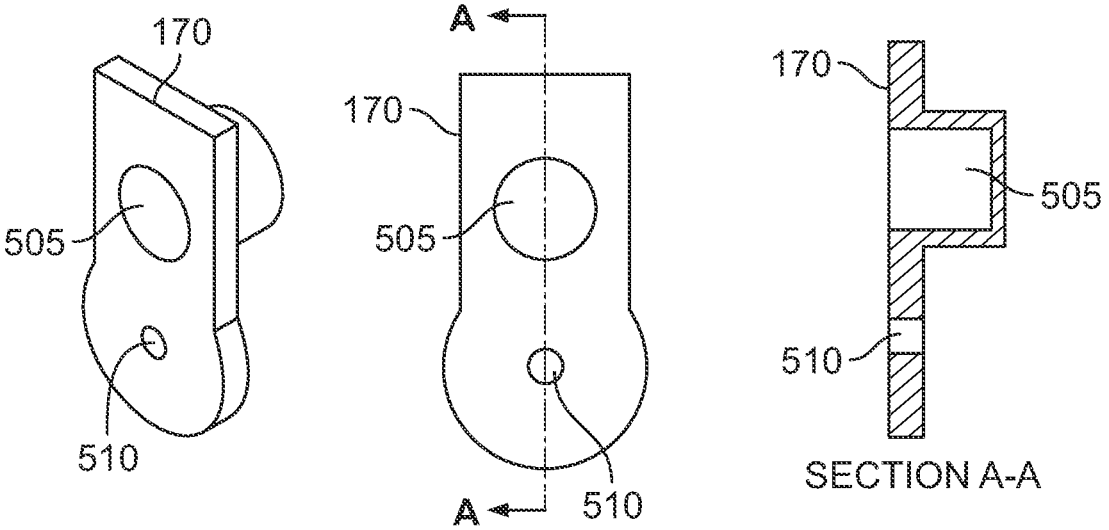
FIG. 5 shows various perspectives and cross-sections of a locking plate of the locking device of FIG. 1.

FIG. 5 shows additional details of some embodiments of rear lock body plate 170. As shown in FIG. 5, rear lock body plate 170 may comprise a recessed portion 505 for accommodating at least a portion of lock plate spring 175. In other implementations, recessed portion 505 may be omitted and lock plate spring 175 may press directly against a face of rear lock body plate 170. In some embodiments, rear lock body plate 170 may further comprise a locking plug recess 510 for engaging with a tab 695 (shown in FIG. 6) of locking plug portion 115 and retaining locking plug portion 115 against rear lock body plate 170 while allowing for rotation of locking plug portion 110, 115 with respect to rear lock body plate 170.

Figure 6:
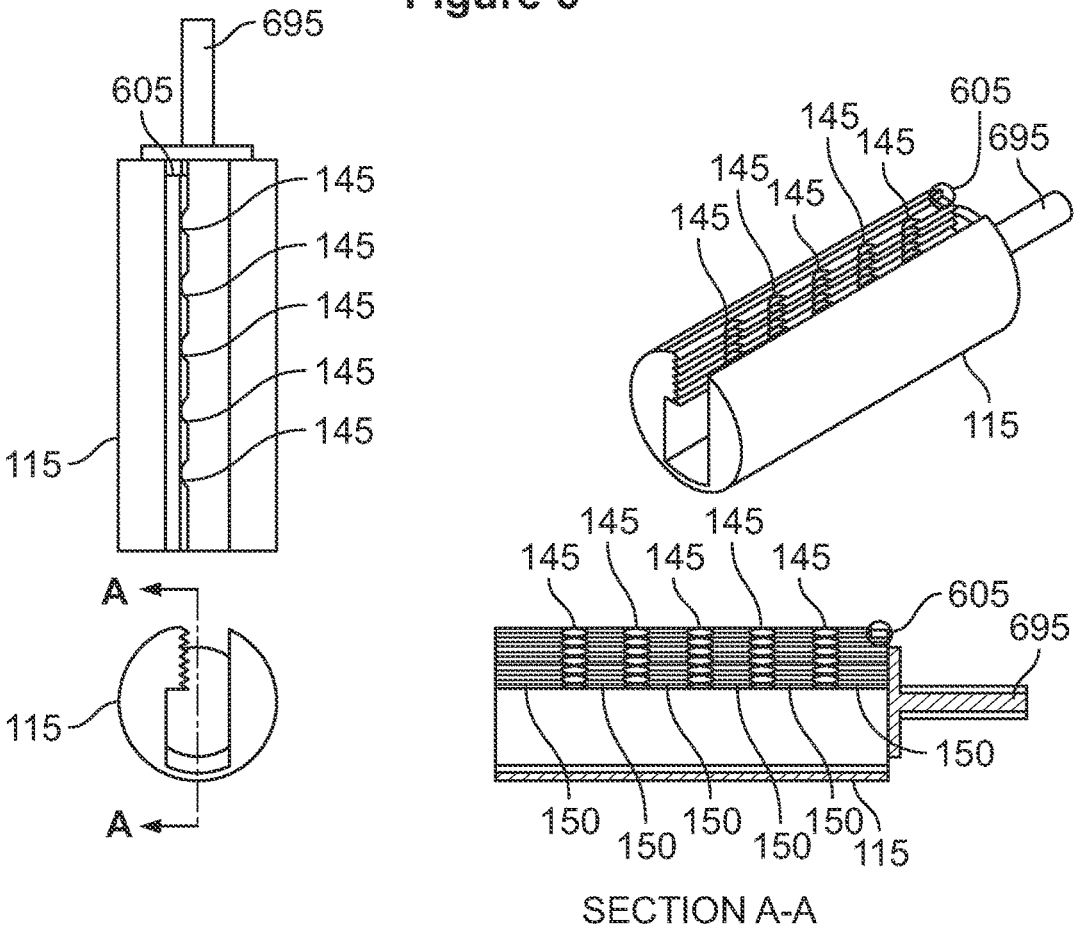
FIG. 6 shows various perspectives and cross-sections of a portion of a locking plug of the locking device of FIG. 1.

FIG. 6 shows an embodiment of locking plug portion 115. As can be seen in FIG. 6, locking plug portion 115 may include rotational stop slot 605 proximate one end of locking plug portion 115. In particular implementations, rotational stop slot 605 is configured to engage with a complementary locking tab 805 (shown in FIG. 8) on pin tumbler holder 120, such that when the locking tab is engaged with rotational stop slot 605, locking plug portion 110, 115 is prevented from rotating with respect to lock body 105 and rear lock body plate 170.

FIG. 11 shows an embodiment of locking device 100 with key 180 inserted. As can be seen in FIG. 11, the insertion of key 180 into locking device 100 has caused key ridge portions 310 to engage with pin tumblers 130, raising them to heights corresponding to the flat areas of key ridge portions 310. As key 180 is the correct key for locking device 100, the pin springs 155 have been compressed, and the upper pins 160 and lower pins 165 raised such that the top ends of lower pins 165 are proximate the upper edge of locking plug portions 110, 115, and the lower ends of upper pins 160 are proximate the lower edge of pin tumbler holder 120, such that locking plug portions 110, 115 may rotate with respect to lock body 105 and pin tumbler 120 without interference of pin tumblers 130.

As can be further seen in the embodiment of locking device 100 shown in FIG. 11, lock plate spring 175 is biasing locking plug portion 110 and pin tumbler holder 120 towards the handle portion 305 of key 180, such that locking tab 805 on pin tumbler holder 120 is engaged with rotational stop slot 605 on locking plug portion 115, thereby preventing locking plug 115 from rotating, even though pin tumblers 130 are in the correct position for opening locking device 100. In some implementations, locking tab 805 controls the movement of locking plug portion 110.

Figure 12:
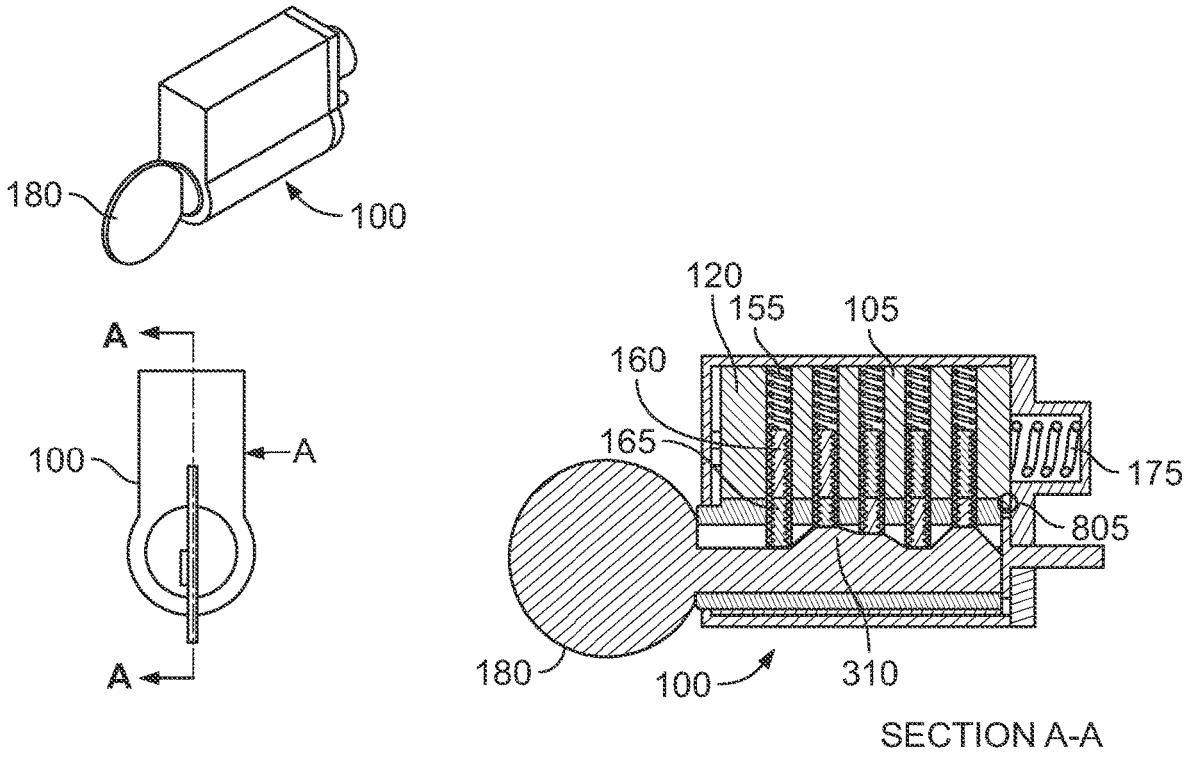
FIG. 12 shows various perspectives and cross-sections of the locking device of FIG. 1 with a key inserted and the first portion of a locking plug and a pin holder in a second position.

FIG. 12 shows the embodiment of locking device 100 from FIG. 11, where the lock plate spring 175 has been compressed (such as, by pushing on handle portion 305 of key 180), and locking plug portion 110 and pin tumbler holder 120 have moved to a second position. In this second position, as shown in FIG. 12, locking tab 805 on pin tumbler holder 120 has moved out of rotational stop slot 605 on locking plug portion 115, thereby allowing locking plug portions 110, 115 to rotate with respect to lock body 105 and open the lock. However, as locking plug portion 110 and pin tumbler holder 120 have moved to a second position with respect to locking plug portion 115, causing the serrated portions of pin tumblers 130 to engage with serrated portions 150 of locking plug portion 115 and preventing further vertical movement of pin tumblers 130.

Figure 13:
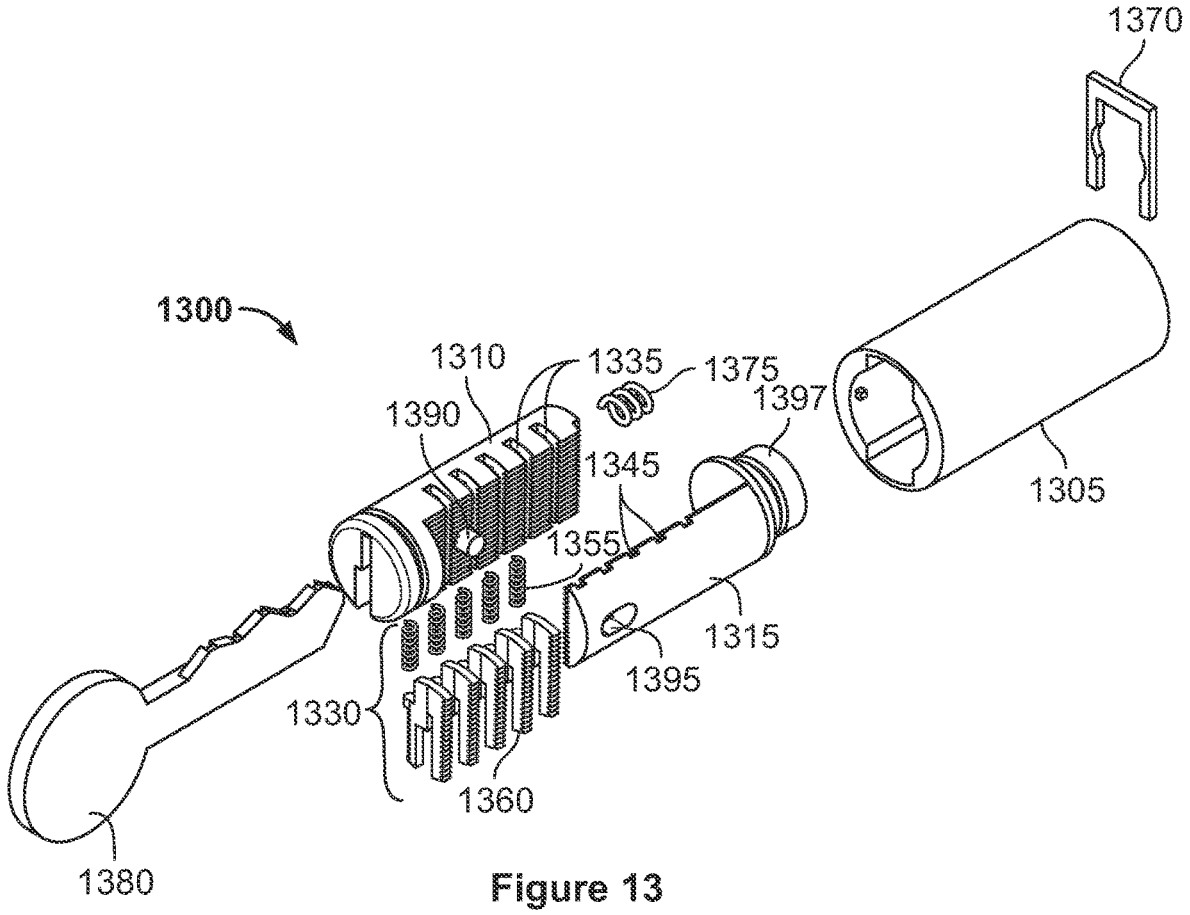
FIG. 13 shows a perspective view of an embodiment of a locking device having wafer tumblers.

Referring now to FIG. 13, an embodiment of an improved locking device 1300 is shown having wafer tumblers. As seen in FIG. 13, some embodiments of an improved locking device may comprise a lock body 1305 and a locking plug having a first portion 1310 and a second portion 1315. In particular implementations, such as shown in FIG. 13, locking plug portion 1310 may be configured to engage with locking plug portion 1315. For example, in some optional implementations, locking plug portion 1310 may comprise a locking plug slide tab 1390 configured to engage with a corresponding locking plug slide cavity 1395 on locking plug portion 1315, so as to limit the range of relative longitudinal movement between locking plug portions 1310, 1315. In some embodiments, lock body 1305 is configured to receive locking plug portions 1310 and 1315 at least partially within lock body 1305.

Figure 17:
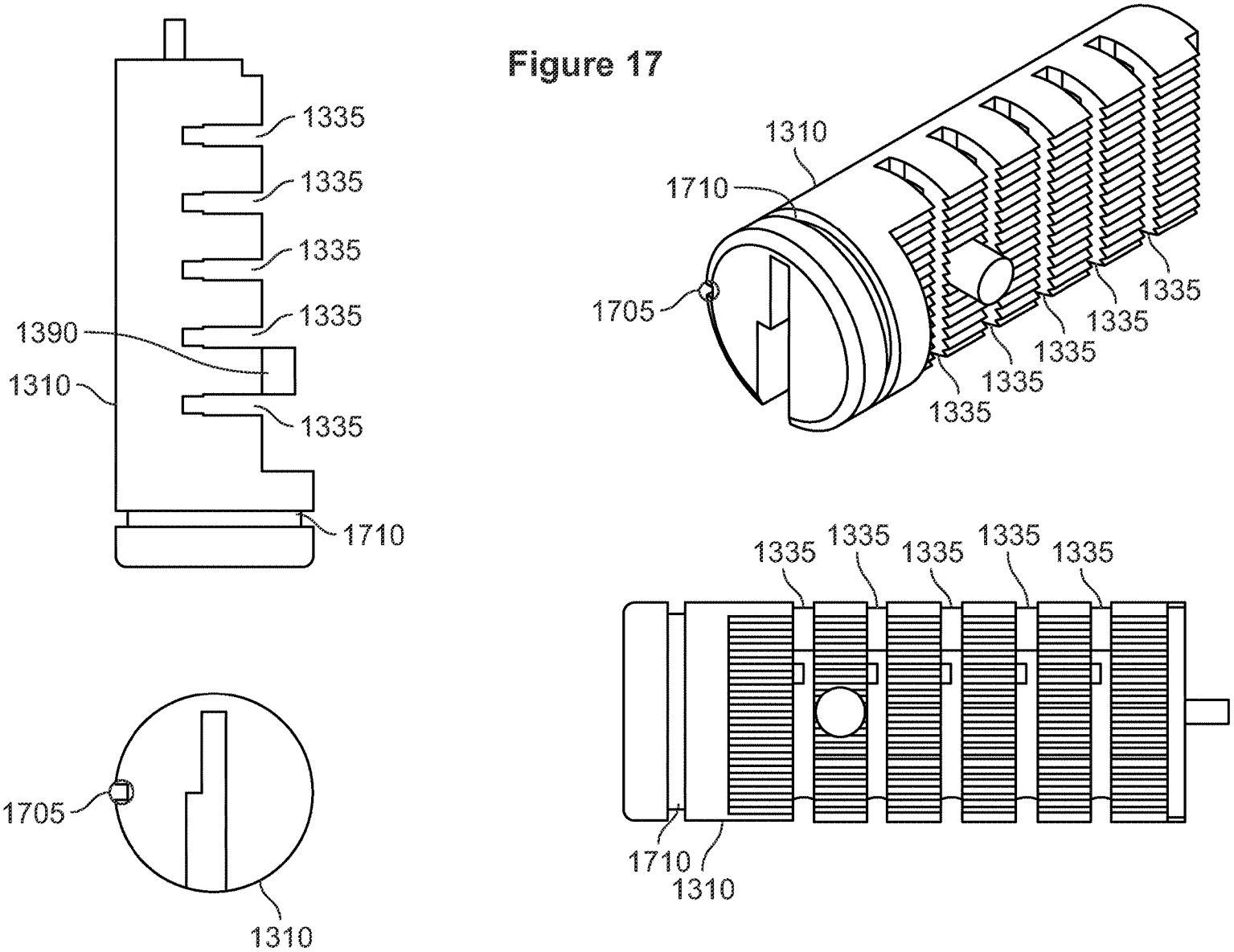
FIG. 17 shows various perspectives and cross-sections of another portion of a locking plug of the locking device of FIG. 13.

As can be further seen in FIG. 13 and FIG. 17, in some embodiments locking plug portion 1310 may include a plurality of channels 1335 for accommodating a plurality of wafer tumblers 1330.

Figure 16:
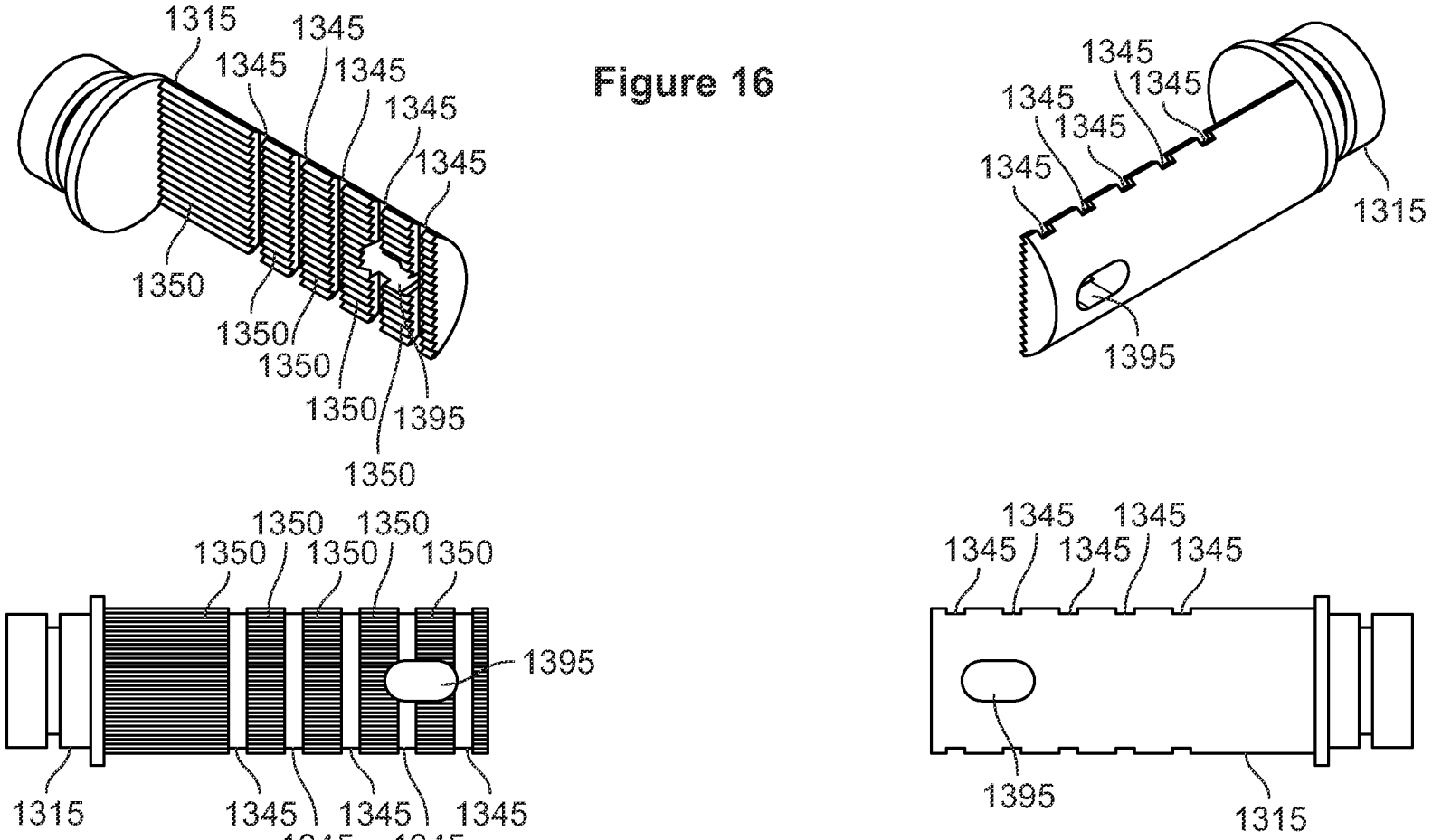
FIG. 16 shows various perspectives and cross-sections of a portion of a locking plug of the locking device of FIG. 13.
Figure 20:
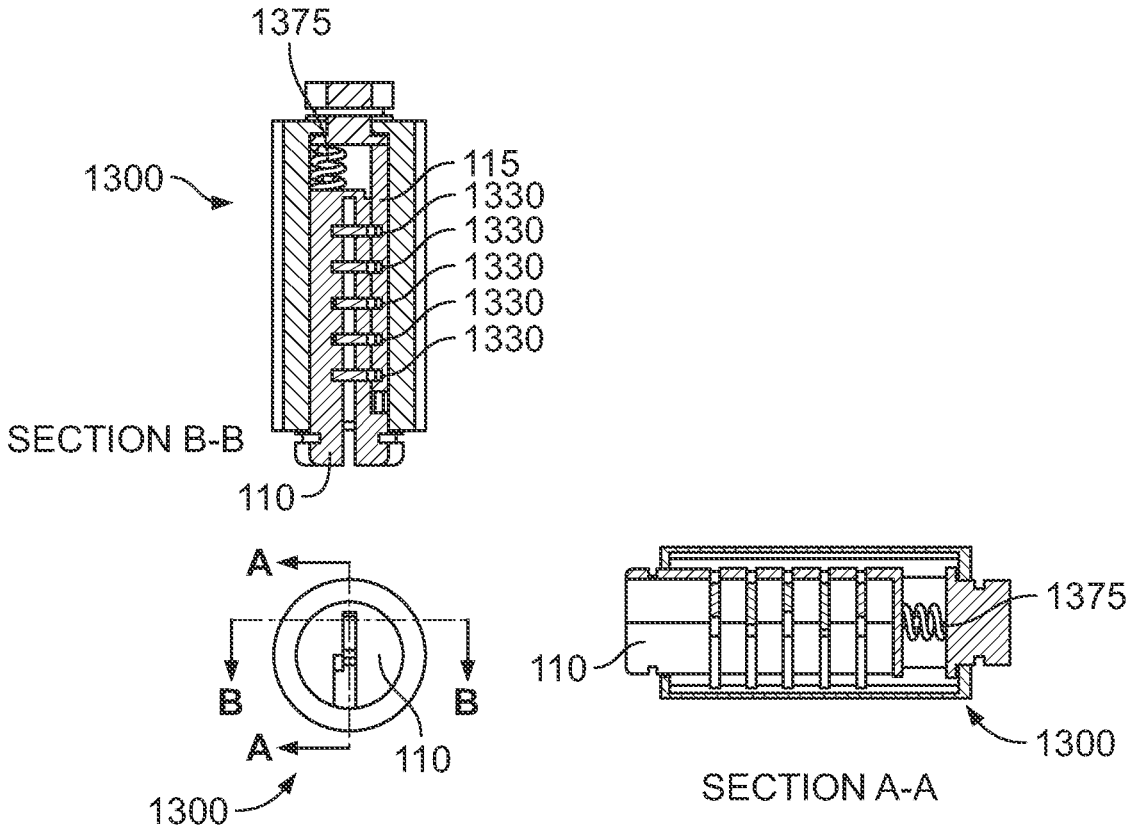
FIG. 20 shows various perspectives and cross-sections of the locking device of FIG. 13 with first and second portion of a locking plug in a first position.
Figure 21:
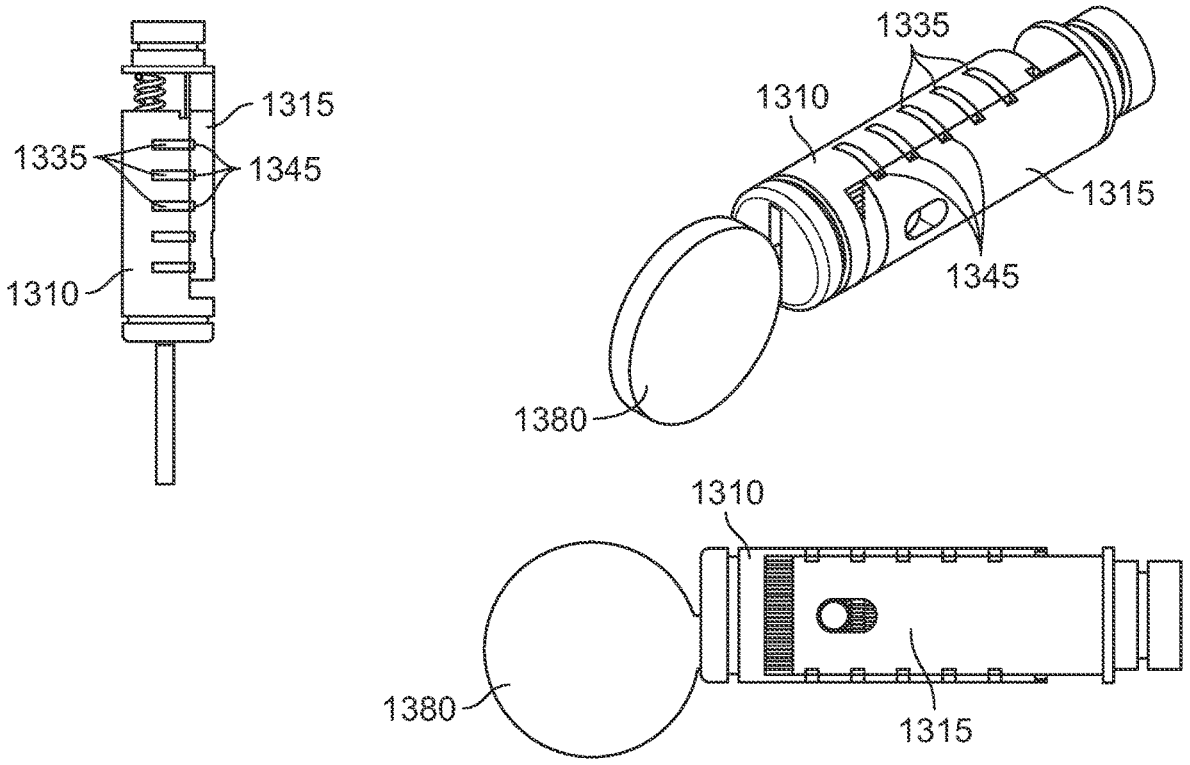
FIG. 21 shows various perspectives and cross-sections of a first and second portion of a locking plug and key of the locking device of FIG. 13 in a first position.

As further shown in FIGS. 13 and 16, in some embodiments, locking plug portion 1315 may comprise a plurality of channels 1345 for accommodating the plurality of wafer tumblers 1330. In particular implementations, and as shown in FIGS. 20 and 21, when the channels 1345 of locking plug portion 1315 are aligned with the channels 1335 of locking plug portion 1310, wafer tumblers 1330 are free to move up and down within channels 1335, 1345. Optionally, as shown in detail with respect to FIG. 16, locking plug portion 1315 may also comprise a plurality of wafer tumbler locking sections, such as serrated portions 1350 for engaging with wafer tumblers 1330 when channels 1345 of locking plug portion 1315 are not aligned with channels 1335 of locking plug portion 1310, thereby preventing wafer tumblers 1330 from moving up and down.

As further shown in FIGS. 13 and 14, wafer tumblers 1330 may comprise a plurality of elements, such as wafer springs 1355 and wafers 1360. Although shown with a particular geometry, wafers 1360 may have a number of different shapes and designs, and wafer springs 1355 may be located in a variety of positions to bias wafers 1360. Wafers 1360 may be of varying lengths with respect to each other and one another, or have varying cut out sizes, such that each wafer tumbler 1330 must be raised a different amount (through the use of a proper key) to allow locking device 1300 to rotate and be opened.

Figure 18:
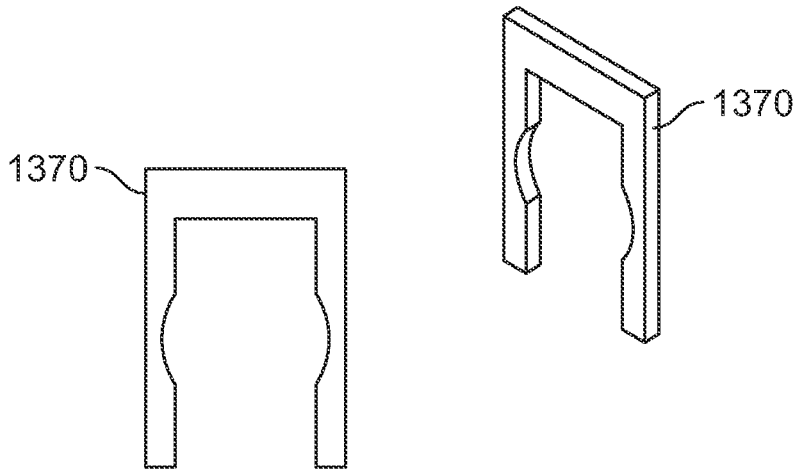
FIG. 18 shows various perspectives of a locking clip of the locking device of FIG. 13.

As further shown in FIG. 13 and FIG. 18, locking device 1300 may further comprise lock clip 1370. In some embodiments, lock clip 1370 is configured to engage with end 1397 of locking plug portion 1315, securing locking plug portion 1315 to lock body 1305. In some embodiments, locking device 1300 may further include lock spring 1375 for biasing locking plug portion 1310 away from end 1397 of locking plug portion 1315. Locking device 1300 may further comprise a key 1380 for operating locking device 1300.

As shown in FIG. 14, wafer tumblers 1330 may in some embodiments have serrated edges. In some embodiments serrated edges of wafer tumblers 1330 may have the same serration frequency as serrated portions 1350 of locking plug portion 1315, such that when wafer tumblers 1330 are aligned with serrated portions 1350 of locking plug portion 1315, wafer tumblers 1330 are prevented from moving up or down with respect to locking plug portions 1310, 1315. In some implementations, the serrations may have the same frequency as the key biting.

Figure 19:
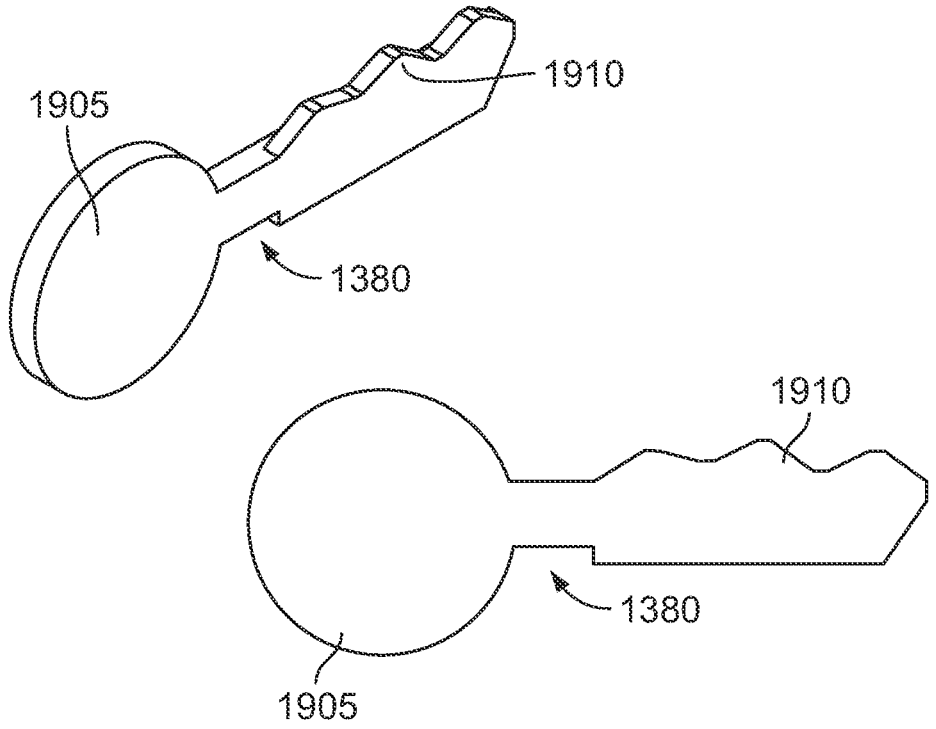
FIG. 19 shows various perspectives of a key for use with the locking device of FIG. 13.

As shown in FIG. 19, key 1380 may comprise a handle portion 1905 and a key ridge portion 1910. As described in further detail below, ridge portion 1910 is configured to engage with wafer tumblers 1330, such that when the correct key 1380 is inserted into locking device 1300, wafer tumblers 1330 are raised by varying heights corresponding to the changes in elevation on ridge portion 1910.

FIG. 15 shows an embodiment of lock body 1305. As can be seen in FIG. 15, lock body 1305 may comprise a cavity 1505 for receiving other components of locking device 1300, including locking plug portions 1310, 1315. As can be further seen in FIG. 15, lock body 1305 may comprise one or more wafer channels 1510, such that when at least a portion of one or more of wafer tumblers 1330 is in one of wafer channels 1510, locking plug portions 110, 115 are unable to rotate with respect to lock body 1305. Additionally, in some embodiments, lock body 1305 may comprise locking tab 1515 (described in detail further below).

Figure 24:
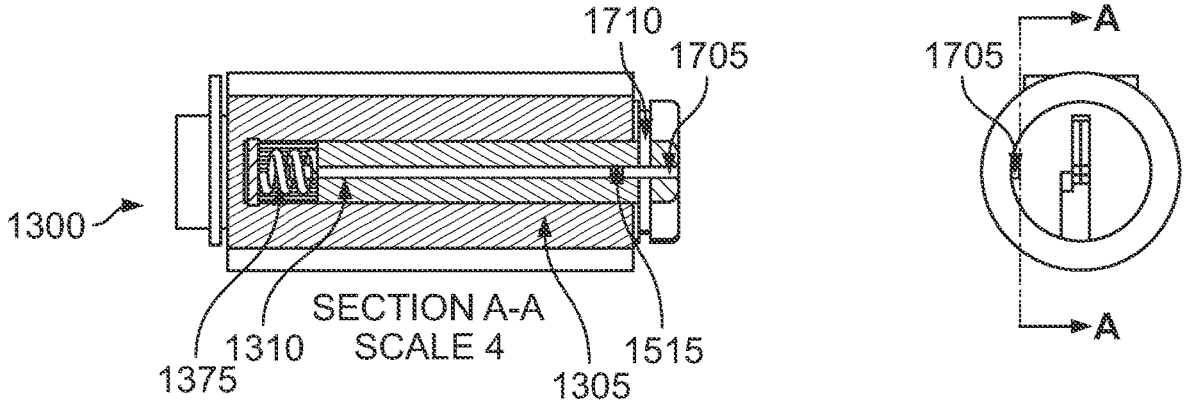
FIG. 24 shows various perspectives and cross-sections of the locking device of FIG. 13.

FIG. 17 shows an embodiment of locking plug portion 1310. As can be seen in FIG. 17 and FIG. 24, locking plug portion 1310 may include rotational stop slot 1705 proximate a longitudinal end of locking plug portion 1310. Optionally, locking plug portion 1310 may also include a rotational ring slot 1710 intersecting rotational stop slot 1705. In particular implementations, rotational stop slot 1705 and rotational ring slot 1710 are configured to engage with complementary locking tab 1515 (shown in FIG. 15) on lock body 1305, such that when the locking tab 1515 is engaged with rotational stop slot 1705, locking plug portion 1310, 1315 is prevented from rotating with respect to lock body 1305. If, on the other hand, locking tab 1515 is engaged with rotational ring slot 1710, locking plug portion 1310, 1315 may rotate with respect to lock body 1305.

FIG. 21 shows an embodiment of locking device 1300 (lock body 1305 not shown), with key 1380 inserted and the locking plug portions 1310, 1315 in a first position with channels 1335, 1345 aligned. Although not shown in FIG. 21, the insertion of key 1380 into locking device 1300 has caused key ridge flat portions 1910 to engage with wafer tumblers 1330, raising them to heights corresponding to the flat areas of key ridge portions 1910. As key 1380 is the correct key for locking device 1300, the wafer springs 1355 have been compressed and wafer tumblers 1330 raised such that the upper and lower edges of wafer tumblers 1330 are outside of wafer channels 1510 on lock body 1305, such that locking plug portions 1310, 1315 may rotate with respect to lock body 1305 without interference of wafer tumblers 1330.

Figure 22:
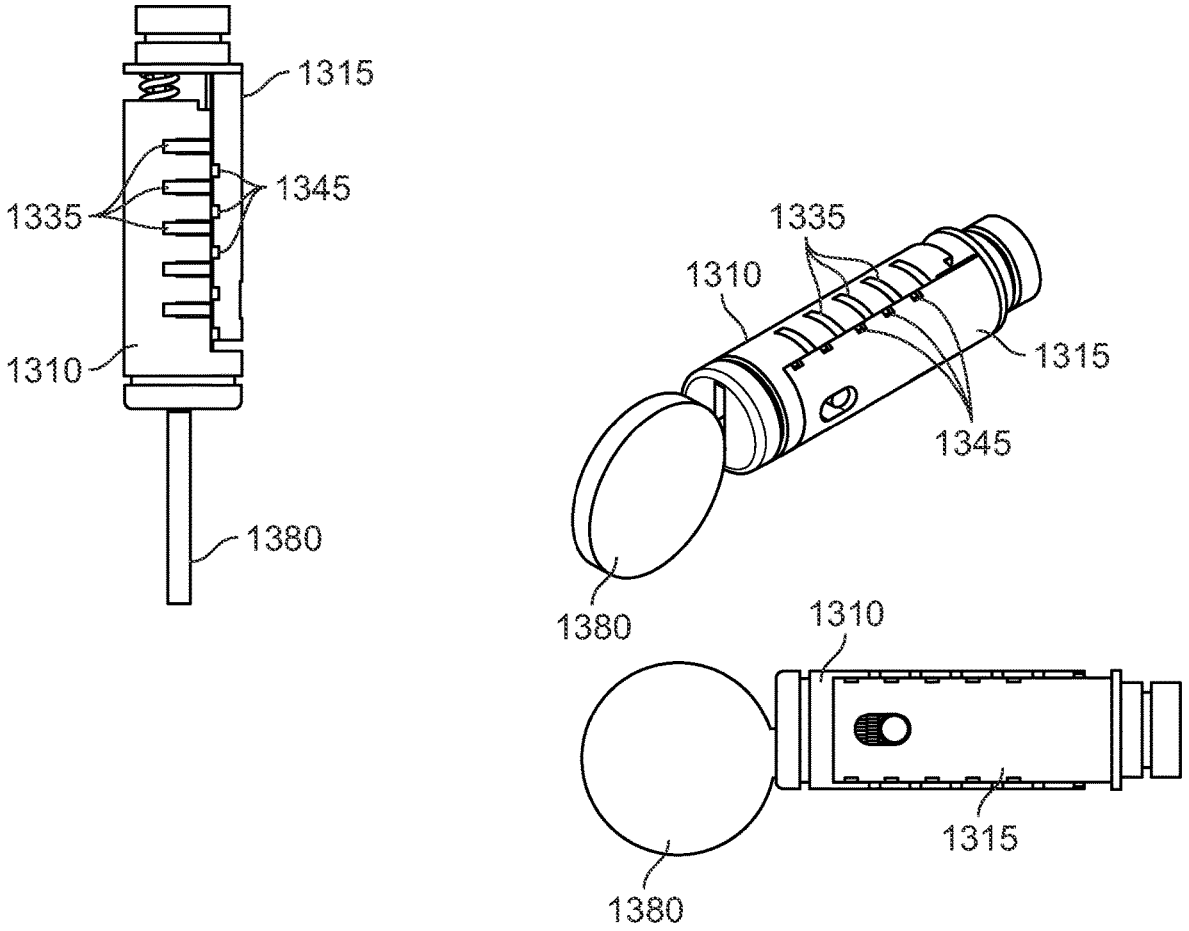
FIG. 22 shows various perspectives and cross-sections of a first and second portion of a locking plug and key of the locking device of FIG. 13 in a second position.

FIG. 22 shows the embodiment of FIG. 21 with key 1380 inserted and the locking plug portions 1310, 1315 in a second position, with channels 1335, 1345 not aligned with one another. In this position, serrated portions 1350 (FIG. 16) of locking plug portion 1315 are engaged with wafer tumblers 1330, preventing wafer tumblers 1330 from moving in the vertical direction.

As can be further seen in the embodiment of locking device 1300 shown in FIG. 20 and FIG. 24, lock spring 1375 is biasing locking plug portion 1310 away from the rear end of lock body 1305, such that locking tab 1515 on lock body 1305 is engaged with rotational stop slot 1705 on locking plug portion 1310, thereby preventing locking plug 1310 from rotating, even though wafer tumblers 1330 may be the correct position for opening locking device 1300.

Figure 23:
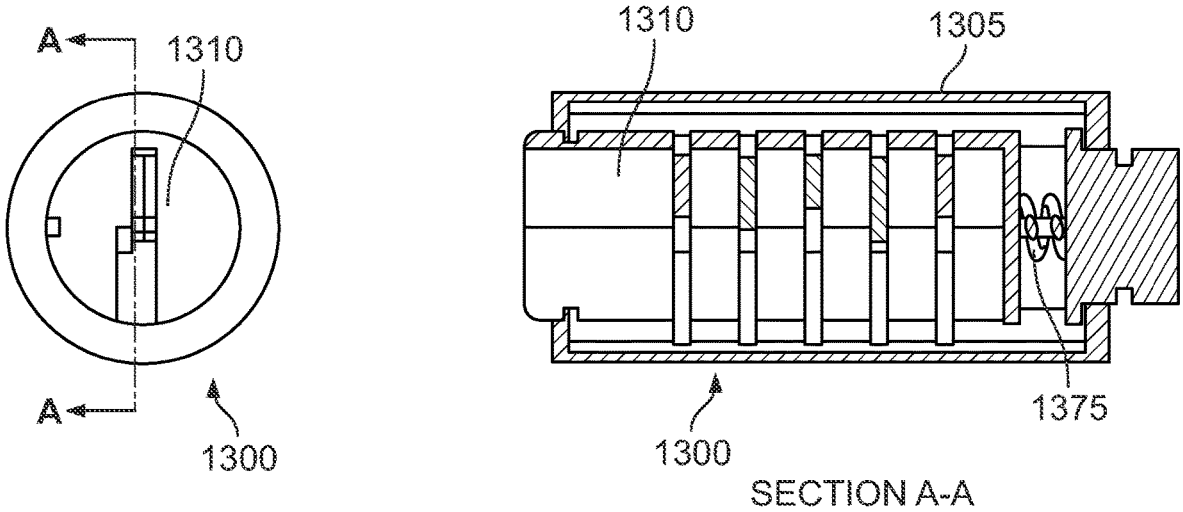
FIG. 23 shows various perspectives and cross-sections of the locking device of FIG. 13 with first and second portion of a locking plug in a second position.

FIG. 23 shows the embodiment of locking device 1300 from FIG. 20, where the lock spring 1375 has been compressed (such as, by pushing on key 1380 or locking plug portion 1310), and locking plug portion 1310 has moved to a second position with respect to lock body 1305 and locking plug portion 1315. In this second position, locking tab 1515 on lock body 1305 has moved out of rotational stop slot 1705 on locking plug portion 110, and has moved into rotational ring slot 1710, thereby allowing locking plug portions 1310, 1315 to rotate with respect to lock body 1305 and open the lock. However, locking plug portion 1310 has moved to a second position with respect to locking plug portion 1315 (such as shown in FIG. 22), causing the serrated portions of wafer tumblers 1330 to engage with serrated portions 1350 of locking plug portion 1315 and preventing further vertical movement of wafer tumblers 1330.

In use, some embodiments of locking device 100 and 1300 depicted in FIGS. 1-23 can be used to open a lock using a key.

In one example, a user may insert a key 180 into locking device 100, when a locking plug portion 110 and pin tumbler holder 120 are in a first position with respect to a lock body 105 and locking plug portion 115. In this first position, channels 135 of locking plug portion 110 are aligned with channels 145 of locking portion 115, such that a plurality of pin tumblers 130 are free to move vertically within channels 135, 145 in response to the insertion of key 180 into locking device 100. Next, a user may push on key 180 to move locking plug portion 110 and pin tumbler holder 120 into a second position with respect to lock body 105 and locking plug portion 115, such that channels 135 of locking plug portion 110 are not aligned with channels 145 of locking plug portion 115, preventing further vertical movement of pin tumblers 130. As locking plug portion 110 and pin tumbler holder 120 move from the first to the second position with respect to lock body 105 and locking plug portion 115, locking tab 805 on pin tumbler holder 120 has moved out of rotational stop slot 605 on locking plug portion 115, thereby allowing locking plug portions 110, 115 to rotate with respect to lock body 105. At this point, the user may further rotate key 180 to open locking device 100.

In another example, a user may insert a key 1380 into locking device 1300, when a locking plug portion 1310 is in a first position with respect to a lock body 1305 and locking plug portion 1315. In this first position, channels 1335 of locking plug portion 1310 are aligned with channels 1345 of locking portion 1315, such that a plurality of wafer tumblers 1330 are free to move vertically within channels 1335, 1345 in response to the insertion of key 1380 into locking device 1300. Next, a user may push on key 1380 to move locking plug portion 1310 into a second position with respect to lock body 1305 and locking plug portion 1315, such that channels 1335 of locking plug portion 1310 are not aligned with channels 1345 of locking plug portion 1315, preventing further vertical movement of wafer tumblers 1330. As locking plug portion 1310 moves from the first to the second position with respect to lock body 1305 and locking plug portion 1315, locking tab 1515 on lock body 1305 has moved out of rotational stop slot 1705 on locking plug portion 1310, and has moved into rotational ring slot 1710, thereby allowing locking plug portions 1310, 1315 to rotate with respect to lock body 1305. At this point, the user may further rotate key 1380 to open locking device 1300.

A number of embodiments have been described. Nevertheless, it will be understood that various modifications may be made without departing from the scope of the following claims.

What is claimed is:

1. A locking device comprising:

a lock body housing a locking plug having a first portion fixed with respect to the lock body and a second portion moveable with respect to the first portion of the locking plug and the lock body, wherein the first portion of the locking plug comprises a plurality of channels for accommodating vertical movement of a plurality of lock tumblers when the second portion of the locking plug is in a first position with respect to the lock body, and wherein the first portion of the locking plug comprises a plurality of engagement surfaces that engage with the plurality of lock tumblers to prevent vertical movement of the lock tumblers when the second portion of the locking plug is in a second position; and a rotational locking tab that prevents rotation of one of the first and second locking plug portions with respect to the lock body when the second portion of the locking plug is in the first position.

2. The locking device of claim 1, wherein the plurality of lock tumblers are pin tumblers.

3. The locking device of claim 2, further comprising a pin tumbler holder having a plurality of pin tumbler channels for accommodating vertical movement of the pin tumblers.

4. The locking device of claim 3, wherein the rotational locking tab is located on a portion of the pin tumbler holder.

5. The locking device of claim 4, wherein the pin tumbler holder is moveable from a first position with respect to the lock body to a second position with respect to the lock body.

6. The locking device of claim 5, wherein the first portion of the locking plug comprises a locking slot configured to engage with the locking tab of the pin tumbler holder when the pin tumbler holder is in the first position.

7. The locking device of claim 1, wherein the plurality of lock tumblers are wafer tumblers.

8. The locking device of claim 7, wherein the rotational locking tab is located on a portion of the lock body.

9. The locking device of claim 8, wherein the second portion of the locking plug comprises locking slot configured to engage with the locking tab of the lock body when the second portion of the locking plug is in the first position.

10. The locking device of claim 9, wherein the second portion of the locking plug further comprises a rotational slot configured to engage with the locking tab of the lock body when the second portion of the locking plug is in the second position, such that the second portion of the locking plug can rotate with respect to the lock body.

11. A method of opening a locking device comprising:

inserting an authorized key into the locking device and rotating the key from a first position to a second position, wherein the locking device comprises a lock body housing a locking plug having a first portion fixed with respect to the lock body and a second portion moveable with respect to the first portion of the locking plug and the lock body, and wherein the locking device hinders simultaneous rotation of the locking plug and vertical movement of a plurality of lock tumblers within the locking device.

12. The method of claim 11, wherein the first portion of the locking plug further comprises a plurality of channels for accommodating vertical movement of the plurality of lock tumblers when the second portion of the locking plug is in a first position with respect to the lock body, and wherein the first portion of the locking plug comprises a plurality of engagement surfaces that engage with the plurality of lock tumblers to prevent vertical movement of the lock tumblers when the second portion of the locking plug is in a second position.

13. The method of claim 11 where the locking device further comprises a rotational locking tab that prevents rotation of one of the first and second locking plug portions with respect to the lock body when the second portion of the locking plug is in the first position.

14. The method of claim 11, wherein the plurality of lock tumblers are pin tumblers.

15. The method of claim 14, wherein the locking device further comprises a pin tumbler holder having a plurality of pin tumbler channels for accommodating vertical movement of the pin tumblers.

16. The locking device of claim 15, wherein the rotational locking tab is located on a portion of the pin tumbler holder.

17. The method of claim 11, wherein the plurality of lock tumblers are wafer tumblers.

18. The method of claim 17, wherein the rotational locking tab is located on a portion of the lock body.

19. The method of claim 18, wherein the second portion of the locking plug comprises locking slot configured to engage with the locking tab of the lock body when the second portion of the locking plug is in the first position.

20. A locking device comprises:

a lock body housing a locking plug having a first portion fixed with respect to the lock body and a second portion moveable with respect to the first portion of the locking plug and the lock body;

a means for hindering rotation of the locking plug when the second portion of the locking plug is in a first position; and a means for hindering vertical movement of a plurality of locking tumblers when the second portion of the locking plug is in a second position.

* * * * *